United States Patent [19]

Van Doorn et al.

[11] 4,136,609

[45] Jan. 30, 1979

[54] BALING PRESS CONTROLS

[75] Inventors: Donald W. Van Doorn; James B. Hawkins; Roy T. Williams; William C. Pease, III, all of Columbus, Ga.

[73] Assignee: Lummus Industries, Inc., Columbus, Ga.

[21] Appl. No.: 840,658

[22] Filed: Oct. 11, 1977

[51] Int. Cl.[2] ..... B30B 15/18

[52] U.S. Cl. ..... 100/51; 100/53; 100/255

[58] Field of Search ..... 100/3, 219, 51, 50, 100/53, 255, 43

[56] References Cited

U.S. PATENT DOCUMENTS

| | | | |
|---|---|---|---|
| 2,780,987 | 2/1957 | Wall | 100/53 X |
| 3,548,744 | 12/1970 | Van Doorn | 100/255 |
| 3,613,567 | 10/1971 | Loughran | 100/3 X |
| 3,805,693 | 4/1974 | Neitzel | 100/255 |
| 3,985,072 | 10/1976 | Van Doorn | 100/255 |

*Primary Examiner*—Billy J. Wilhite
*Attorney, Agent, or Firm*—Hugh P. Carter

[57] ABSTRACT

The specification discloses apparatus for baling fibers in which the baling chamber is defined at least in part by one wall mounted for movement from a first position relative to an opposite wall to a second position farther from the second wall. There is means for moving the movable wall away from the second wall after the platen has entered the baling chamber but prior to final compression of the bale therein or means to move the wall in response to a predetermined bale compressing position of the movable platen. Further, the wall may be moved in response to a predetermined compressive force exerted by the platen on the bale. Still further, means is provided to overcompress the bale to some extent thus to destroy some of the inherent spring-back of the bale of fibers.

4 Claims, 5 Drawing Figures

BALING PRESS CONTROLS

Our invention relates to an improved apparatus for baling fibers, particularly resilient fibers such as cotton, man-made substitutes therefor and the like.

In this art it is customary to bale fibers by compressing them between relatively movable platens and while holding them compressed, to place thereabout a number of ties, thus to secure the bale for shipment. In many instances, the bale forming operation is carried out by introducing the fibers into a baling chamber having fixed walls, the platen or platens generally being movable into the box thus formed. In certain other instances, namely, the so-called "doorless" presses, the bale is formed in a fixed wall chamber and then extruded either upwardly or downwardly therefrom, prior to being tied out. In the case of the fixed box press a good deal of power is required to overcome the side wall friction and in addition, when fully compacted the doors are often difficult to open due to the side thrust of the fibers. With regard to the so-called doorless press, this type mechanism requires the use of two movable rams, one of which is a compacting ram and the other of which is the opposing ram. Additionally, the total movement of the compacting ram in a doorless press has to be sufficient to cause the bale to clear the box.

With the foregoing in mind an object of our invention is to provide apparatus for baling fibers which may embody a single movable ram and a fixed platen, between which the bale is compacted, together with means at the appropriate time in the operation to cause at least one of the side walls of the press box to move away from an opposite wall, thus to reduce the power required.

A further object of our invention is to cause the movement of the wall or walls of the press away from the bale in response either to a predetermined position of the platen or, a predetermined force exerted on the bale by the platen.

Another object is to provide a baling press of the character designated equipped with means to cause at least one wall to move away from an opposite wall at a time during the baling process when such movable wall is free to move without the application of excessive forces.

Another object of our invention is to provide baling apparatus which shall be capable of forming bales which are more nearly square, namely, in which the corners are better filled out than heretofore and which also shall be capable of producing bales having less tendency to expand or "bloom" when the straps are cut.

Apparatus illustrating features of our invention is shown in the accompanying drawings, forming a part of this application, in which.

Reference is now made to the disclosure of U.S. Pat. No. 3,985,072 dated Oct. 12, 1976, assigned to the assignee of the instant application from which patent FIGS. 3, 4 and 5 herein are taken. Our present invention, and as will be described and illustrated in this application, is ideally suited for association with the structure shown, described and claimed in said patent. Thus, we may adapt our present control system to a press box construction as shown in said patent and it is effective to operate the said patented baling chamber in a fashion to obtain the advantages of our present invention. Therefore, and for the sake of incorporating some of the teachings of the aforesaid patent in the present application, we will employ the same numerals for the parts, where applicable. We then will associate with the mechanism of said patent the apparatus which results in the improvements herein claimed.

Figure 2:
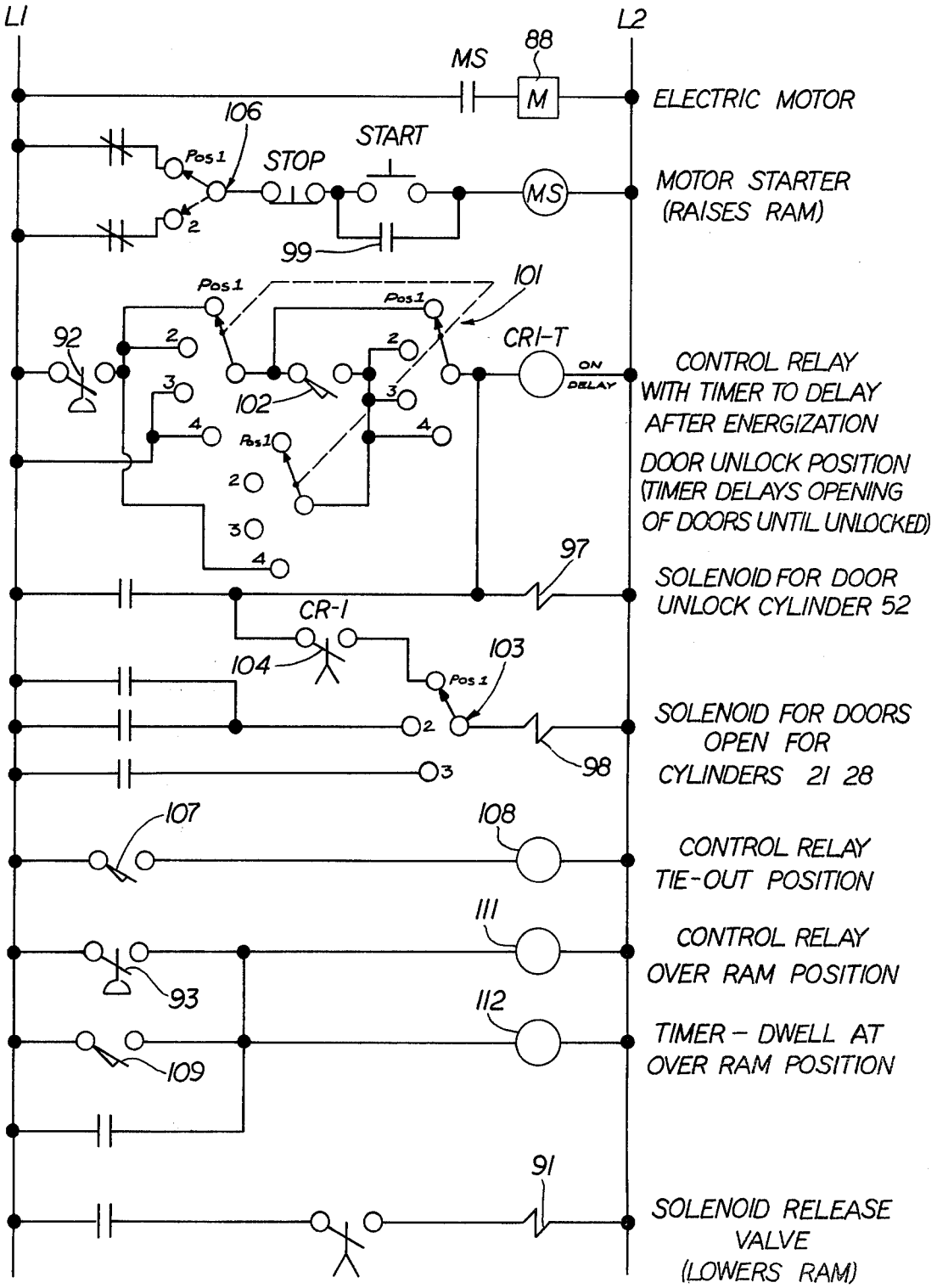
FIG. 2 is a wiring diagram.
Figure 3:
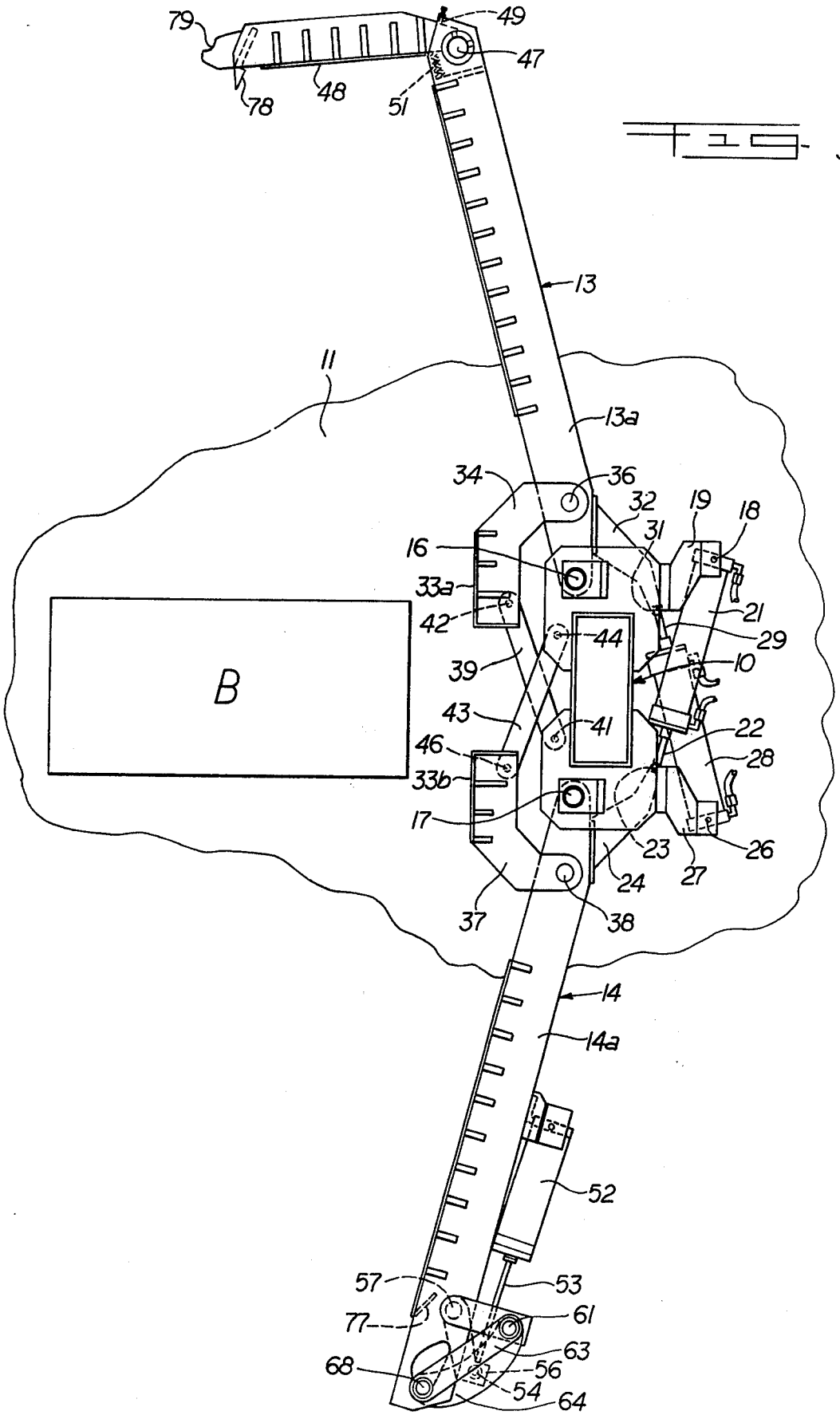
FIG. 3 is a somewhat diagrammatic view of a baling press chamber with which our invention may be associated, the parts being in fully open position.
Figure 5:
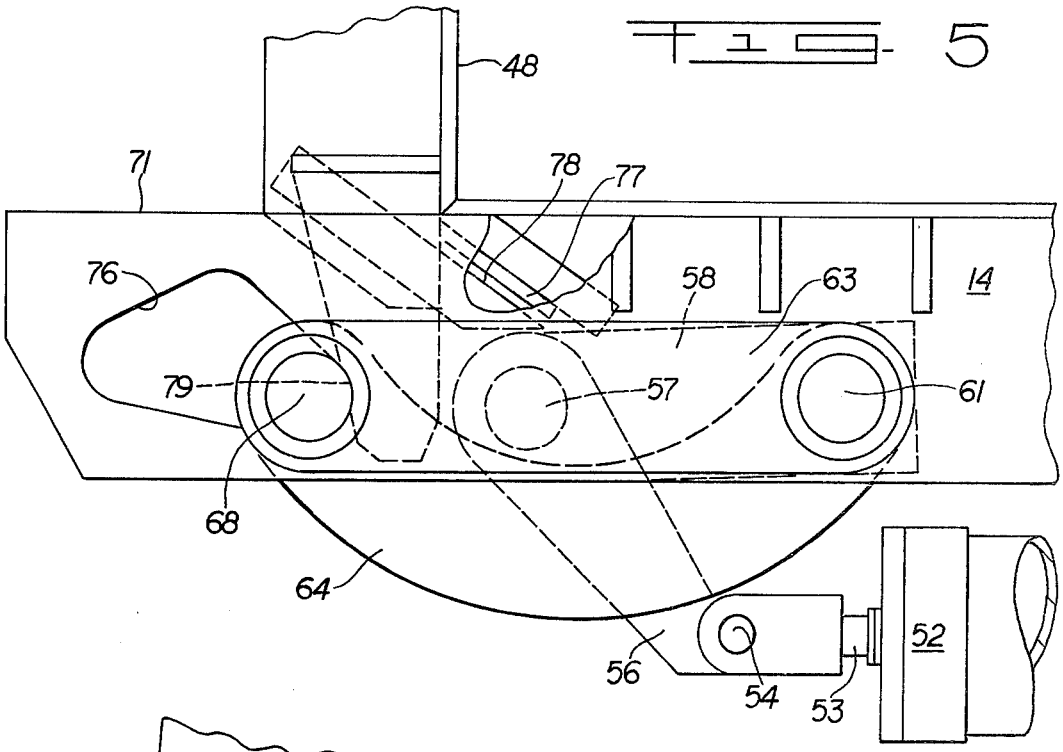
FIG. 5 is a view corresponding to FIG. 4 and showing the doors in fully locked position.
Figure 4:
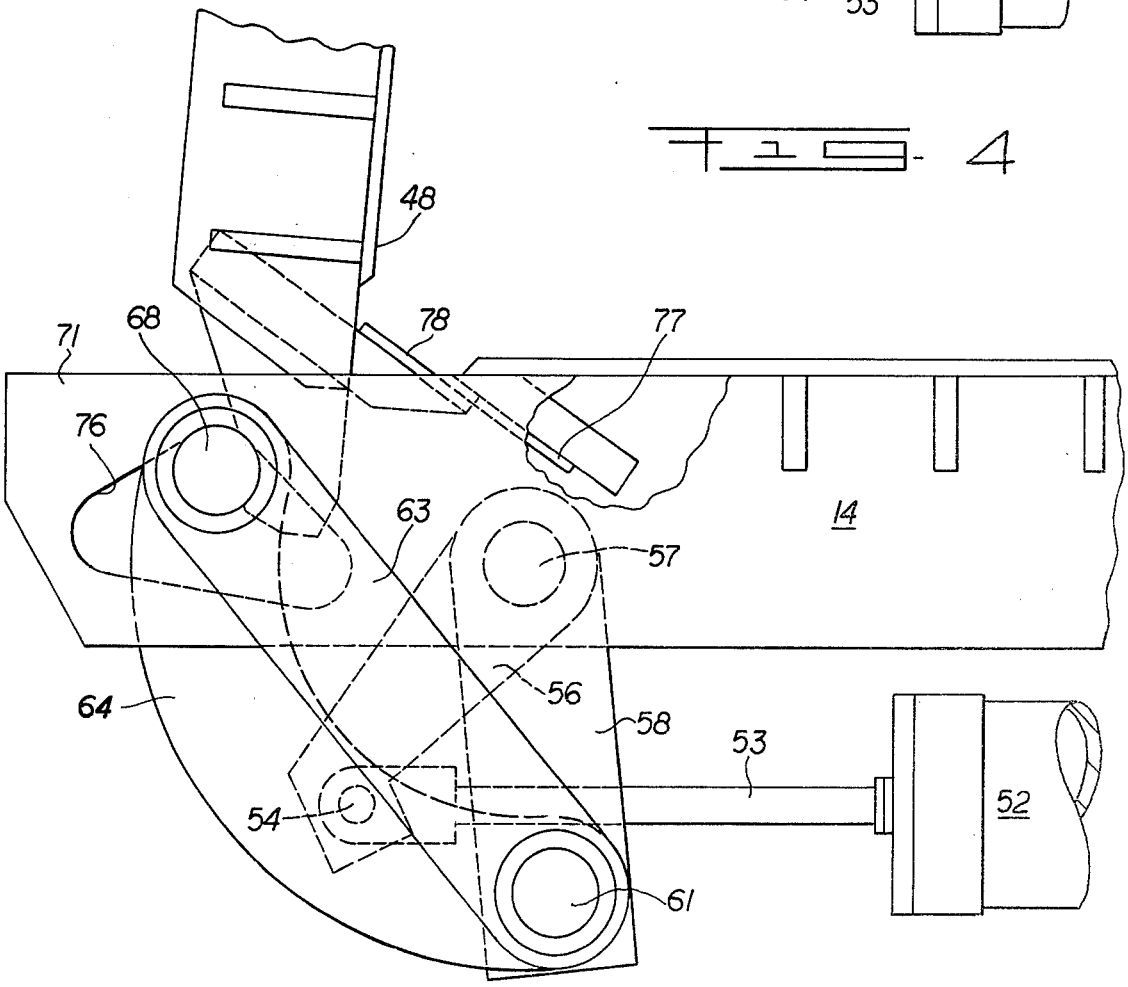
FIG. 4 is an enlarged detail fragmental plan view of the locking system with the doors substantially closed but prior to the actuation of the locking mechanism for the doors.

Referring now particularly to FIGS. 3, 4 and 5, the type of baling press construction shown in said U.S. Pat. No. 3,985,072 will first be described. Said baling press comprises a main supporting floor 11 and may be anchored to an overhead structure which in said patent is indicated at 12. It is from this supporting structure 10 that side walls 13 and 14 are pivoted as indicated at 16 and 17, respectively. Also as shown in said patent in FIG. 3, it will be seen that there are in fact upper and lower sets of the pivots 16 and 17, only those relating to the wall 14 of which are shown in FIG. 2 of said patent.

Pivotally mounted at 18 to a suitable, heavy duty bracket 19 is a fluid pressure cylinder 21. The piston rod 22 of cylinder 21 is pivotally connected at 23 to a bracket 24 carried by the wall 14.

In similar manner, pivotally mounted at 26 to a heavy duty bracket 27 carried by the supporting structure 10 is another cylinder 28. The piston rod 29 of cylinder 28 is pivotally connected at 31 to a bracket 32 which is carried by the wall 13. As is shown in the drawings these cylinders are both double acting and fluid under pressure from a suitable source and under control of suitable valves, not shown, may be applied to the respective ends to cause the respective piston rods to move from the position with the side walls 13 and 14 substantially parallel to the position shown in FIG. 3 of this application. It will thus be apparent that the walls 13 and 14 may be moved when the mechanism is unlocked as will be explained, from a position forming parallel sides of a baling chamber to the full open position as shown in FIG. 3 of this application.

Adjacent the pivoted ends of the walls 13 and 14 we show an end wall which is split vertically into two halves, $33^a$ and $33^b$. The half $33^a$ of the end wall carries upper and lower sets of brackets 34 which are pivoted at 36 to the upper and lower extended frame members $13^a$ of the side wall 13. The other half $33^b$ of the end wall carries brackets 37 pivotally mounted at 38 to the upper and lower extended frame members $14^a$ carried by side wall 14.

A link 39 is pivoted at 41 to a stationary part of the supporting framework 10. The opposite end of link 39 is pivoted at 42 adjacent the free end of the section $33^a$ of the end wall. In similar manner a link 43 has one end pivoted at 44 to a part of the stationary framework and its opposite end is pivoted at 46 to the section $33^b$ of the end wall.

From what has been so far described it will be seen that the side walls 13 and 14 may pivot about their respective pivots 16 and 17 from a closed position to the position of FIG. 3. Sections $33^a$ and $33^b$ making up the end wall not only move away from each other, but also move away from the adjacent end of the bale B which has been formed while the parts were closed.

Mounted on a vertical shaft 47 on the free end of one of the walls, for instance 13, is an opposite end wall 48. The end wall 48 is free to pivot on its shaft from a position to form an opposite end wall of the baling chamber to the open position as shown in FIG. 3 of the instant application. Further, the end wall 48 is free to pivot on its shaft from the closed position to the position shown in FIG. 3 at which the stop member 49 is engaged by the wall 48 to prevent further clockwise pivoting movement as viewed in FIG. 3. A spring 51 is mounted in position to bias the wall 48 against the stop whenever the parts are unlocked.

Mounted on the wall 14 is a double acting fluid pressure cylinder 52 having a piston rod 53. The piston rod 53 is pivotally connected at 54 to an arm 56 which is carried by a vertically disposed shaft 57 mounted in suitable bearings adjacent the free end of the pivoted wall 14. See FIG. 4 of the present application.

Fast on the shaft 57 are upper links 58 and lower links 59 (shown only in FIG. 2 of U.S. Pat. No. 3,985,072). Carried on the ends of the links 58 are pins 61 and carried by the links 59 are pins 62. Pivotally mounted about the pins 61 is an upper straight link 63 and a lower curved link 64. As shown in said patent there are similar lower straight and curved links secured to the pins 62.

Mounted on the outer ends of the links 63 and 64 is an upper floating locking bar 68. Mounted on the outer ends of the links 66 and 67 is a lower floating locking bar 69, not shown.

From what has been described it will be seen that when the cylinder 52 oscillates or rocks the shaft 57 through the arm 56 the locking bars 68 and 69 are free to move in effect toward and from the shaft 57.

It will be seen that the wall 14 which carries the cylinder 52 is provided with an upper extension 71 and a corresponding lower one, not shown. These are in the form of side beams which add strength to the wall and which may be made up of horizontal plate members. Carried by the horizontal plate members are cam plates 77. As shown in FIGS. 4 and 5 these plates are placed at an angle to the longitudinal axis of the wall 14.

Secured to the wall 48 adjacent its free end are upper and lower cam plates 78 which are adapted as will appear to engage with and slide against the plates 77 when the parts are brought into final closing position. The free end of the wall 48 carries an extension plate 81 which has a notch 71 therein.

Starting with the parts in the position of FIG. 5, namely the locked position, it will be seen that when cylinder 52 is actuated its piston rod moves to the left as viewed in FIGS. 4 and 5. The first action is for the parts to move substantially to the position of FIG. 4 where the cam plates 78 are about to slide off of the plates 77. This has resulted in the walls of the press moving slightly apart, that is to say, to slightly increase the inside dimensions of the press. Further continued leftward movement of piston rod 53 disengages plates 77 and 78, permitting the press to open to the position shown in FIG. 3.

As before stated, while there may be many different types of baling apparatus with which our present invention may be associated, the foregoing is a good example to which our invention is ideally suited.

Figure 1:
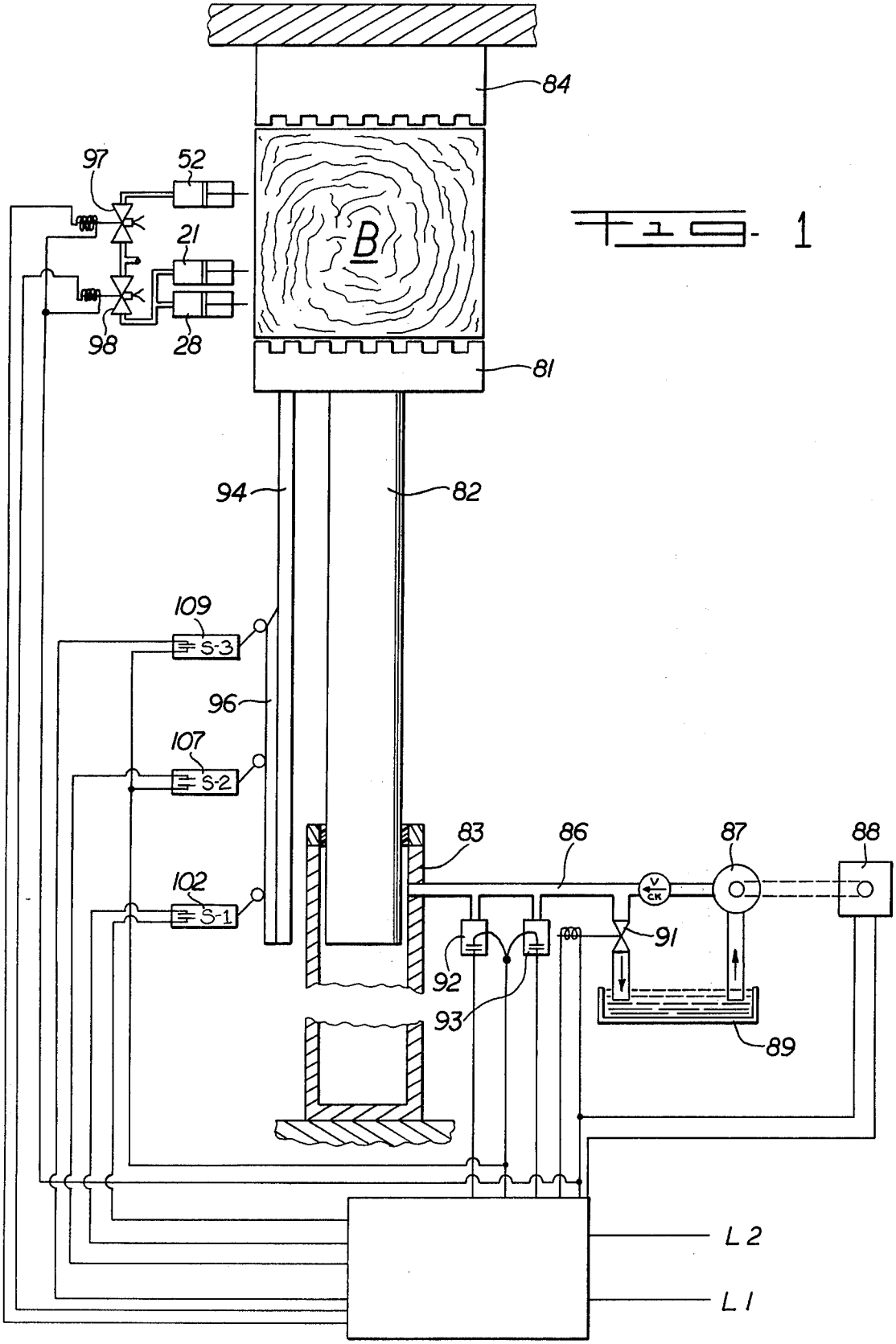
FIG. 1 is a somewhat diagrammatic, sectional view showing our invention associated with an up-packing, single ram type of apparatus.

Referring now to FIG. 1 we show a movable platen 81 which is mounted upon the upper end of a ram 82, the ram in turn being carried by a hydraulic cylinder 83, all as is common in the art. A fixed platen 84 is provided and the bale B is formed or compacted between the two platens 81 and 84.

Fluid for causing the ram to rise is supplied in the usual manner to the cylinder 83 through a line 86. Fluid under pressure is supplied to the line 86 by a pump 87 operated by a suitable motor 88. A fluid reservoir is indicated at 89. A solenoid dump valve is shown at 91 to permit fluid from beneath the ram to return to the reservoir when the ram lowers. Associated with the line 86 are pressure switches 92 and 93. The function of these will later be explained.

Mounted on a side of the ram is a control rod or bar 94. The bar 94 carries a switch cam 96. Associated with the switch cam are switches S1, S2 and S3 each of which has switch arms which bear against the cam as indicated. In the position shown, switches S1, S2 and S3 are shown in actuated positions, namely, the arms have been moved from the off-shelf positions.

The cylinder 52 is under control of a solenoid valve indicated by the numeral 97 which the cylinders 21 and 28 are under control of a solenoid valve indicated at 98.

Referring now to FIG. 2 we show a wiring diagram for the mechanism already described which will be applicable to an up-packing baler with four opening doors which are closed and locked. Further, the switch gear in FIG. 2 will be in those positions they occupy when the ram is at the bottom of its stroke as distinguished from being at the top of its stroke as shown in FIG. 1.

To start the system the push button marked "start" in FIG. 2 is momentarily depressed. This energizes the motor starter MS which locks itself in through its own contacts 99 in turn energizing motor 88, thus driving the pump 87. Since the solenoid release valve 91 is deenergized and its conduit is closed, oil is delivered from the pump to the cylinder 83 forcing the ram 82 upwardly.

A four-position switch 101 is provided to select when the doors unlock. Thus, and as shown in FIG. 2, position one is when pressure switch 92 actuates closed; position two when pressure switch 92 and a limit switch 102 both are actuated closed; position three when limit switch 102 is actuated closed; and position four, when pressure switch 92 or limit switch 102 is actuated closed.

When conditions under control of switch 101 are satisfied, a control relay CR1T becomes energized and locks itself in. This energizes the door unlock solenoid valve 97 to permit air to flow to cylinder 52 to unlock the doors. This moves the locking mechanism from the position of FIG. 5 to the position of FIG. 4.

The movement of the doors to fully open position is under control of a three-position selector switch 103. These positions are: position one, doors open when the doors unlock; position two, doors open at strap position; and, position three, doors open when ram is all the way up. In practice with switch 103 in position one, a slight delay is provided so that the doors may unlock before they attempt to open. If it is necessary to this end we show a timed pair of relay CR1 contacts indicated at 104.

Still another selector switch is provided, namely, a two-position selector switch 106 in which: position one, ram stops on upstroke at tie out position; and position two, the ram travels past tie out position to a further compaction position.

Normally the doors would unlock prior to the ram reaching the strap position through the actuation of switch 92 and/or the actuation of switch 102. When the ram reaches the strap position to close a limit switch 107, thus to energize a relay 108, if switch 106 is in position 1 the energization of relay 108 allows its contacts to open, deenergizing the motor starter MS, stopping the ram in this tie out position. If, however, switch 108 is in number two position the energization of relay 108 has no effect in stopping the ram. However, if switch 103 is in position two, then the closing of relay 108 contacts would energize the door open solenoid for cylinders 21 and 28.

Assume switch 106 to be in the number two position. The ram therefore passes through the tie out position to further compact the bale. The upward travel of the ram now is under control of switch 93 or a limit switch 109. The closing of either of these switches energizes a relay 111 which locks itself in. Since switch 106 is in position two, the opening of the contacts of relay 111 deenergizes the motor starter MS, stopping the ram in this uppermost position. With the closing of pressure switch 93 or 109, not only is relay 111 energized, but a timer 112 also is energized. The ram therefore dwells in this overcompacted position until timer 112 times out. Both the overcompaction and the dwell in the over-ram position aid in "killing" the fibers of the base as well as in firming up the rounded edges of the bale. When the timer 112 times out its contacts close. Since switch 107 is now closed energizing relay 108, continuity is established through the closed contacts of the timer 112 and the closed contacts of relay 108 to energize the solenoid release or dump valve 91. The opening of valve 91 allows oil to flow from beneath the ram back to the tank 89. This permits the ram to descend. When the ram descends to a position where switch 107 is opened, this in turn deenergizes relay 108, opening contacts of relay 108 to deenergize the solenoid dump valve, thus to close the oil path from beneath the ram back to the tank which in turn stops the downward travel of the ram at the tie out position.

From what has been describe it will be seen that in the first instance the ram has been stopped on its upward travel at the tie out position, whereas as just described the ram has stopped at the tie out position after it has overrammed or overcompressed the bale.

If switch 103 had been in position two, the deactuation and opening of the contacts of relay 108 would not deenergize the door opening solenoid for the cylinders 31 and 28. This is so because relay 111 is energized and locked in and its contacts are maintaining the door open solenoid energized.

It is realized that the description of the circuitry stops at the point indicated, namely with the doors fully open and with the ram at the tie out position. It is further realized that additional circuitry would be required to close the doors by deenergizing the holding relays plus additional circuitry for again energizing the solenoid release valve 91 to allow the ram to descend all the way down. However, in view of the fact that such circuitry is old and well known in the art we will not include it in this application. Suffice it here to say that our invention can be adequately explained with reference with what has been described and that additional circuitry may be used and in fact may be required to make a practical system out of what we have described.

While we have shown our invention in but one form, it will be obvious to those skilled in the art that it is not so limited but is susceptible of various changes and modifications without departing from the spirit thereof.

What we claim is:

1. In apparatus for baling fibers, (a) a baling chamber defined in part by at least one wall which is mounted for movement from a first position relative to an opposite wall to a second position farther from said second wall, (b) a movable platen adapted to compress a quantity of fiber in the baling chamber thus to form a bale, and (c) means responsive to the entry of the platen into the baling chamber when it contains fiber to move said movable wall away from the second wall prior to final compression of the bale therein.

2. In apparatus for baling fibers, (a) a baling chamber defined in part by at least one wall which is mounted for movement from a first position relative to an opposite wall to a second position farther from said second wall, (b) a movable platen adapted to compress a quantity of fiber in the baling chamber thus to form a bale, and (c) means responsive to a predetermined bale compressing position of the movable platen to move said wall from said first position toward said second position.

3. In apparatus for baling fibers, (a) a baling chamber defined in part by at least one wall which is mounted for movement from a first position relative to an opposite wall to a second position farther from said second wall, (b) a movable platen adapted to compress a quantity of fiber in the baling chamber thus to form a bale, and (c) means responsive to the development by the movable platen on the bale of a predetermined compressive force to move said wall from said first position toward said second position.

4. In apparatus for baling fibers, (a) a baling chamber defined in part by at least one wall which is mounted for movement from a first position relative to an opposite wall to other positions farther removed from said opposite wall, (b) a movable platen adapted to compress a quantity of fibers in the baling chamber thus to form a bale, (c) means responsive to partial compression of the bale to move said wall from said first position to a second position farther removed from the opposite wall than the first position, and (d) means responsive to further compression of the bale to move said wall to a third position which is farther removed from said opposite wall than said second position.

* * * * *